US007665786B2

(12) United States Patent
Simons

(10) Patent No.: US 7,665,786 B2
(45) Date of Patent: Feb. 23, 2010

(54) FOLDING TONGS

(76) Inventor: Jonathan Simons, 3716 Route 373, Kempton, PA (US) 19529

( * ) Notice: Subject to any disclaimer, the term of this patent is extended or adjusted under 35 U.S.C. 154(b) by 3 days.

(21) Appl. No.: 11/448,987

(22) Filed: Jun. 8, 2006

(65) Prior Publication Data

US 2007/0284899 A1 Dec. 13, 2007

(51) Int. Cl.
*B25B 9/00* (2006.01)

(52) U.S. Cl. ..... 294/99.2

(58) Field of Classification Search ..... 294/99.2, 294/26, 16

See application file for complete search history.

(56) References Cited

U.S. PATENT DOCUMENTS 2,346,537 A 4/1944 Fernandez
3,596,965 A * 8/1971 Woofter ..... 294/8
6,581,997 B1 6/2003 Martikainen et al.
7,086,676 B2 * 8/2006 Sumter et al. ..... 294/16

FOREIGN PATENT DOCUMENTS

DE 102004050632 * 4/2006
WO WO 97/41762 A1 11/1997

* cited by examiner

*Primary Examiner*—Paul T Chin
(74) *Attorney, Agent, or Firm*—Edell, Shapiro & Finnan, LLC

(57) ABSTRACT

A foldable tongs unit of the type having two pivotally joined legs has a storage position in which the legs lie in flush abutting relation so that the total thickness of the tongs unit in its storage position is the thickness of the two legs. Three transversely spaced fingers on each leg, when unstressed, reside in the plane of the leg and provide both the pivotal connection and the resilient bias against which the tongs are operated. The thickness of each of the joined non-flexing fingers is increased at the proximal end of the unit (i.e., at the hinge), permitting the pivot axis to be located substantially in the plane of abutment between the two legs in the storage position of the unit. In the actuation position, the ends of the foreshortened flexing fingers abut non-flexing fingers of the opposite leg to provide the desired resilient gripping function.

14 Claims, 8 Drawing Sheets

FOLDING TONGS

BACKGROUND OF THE INVENTION

1. Technical Field

The present invention pertains to folding tongs and, more particularly, to improvements in tongs of the type in which two legs are resiliently biased to an open position and foldable to a collapsed storage position.

2. Discussion of the Art

U.S. Pat. No. 2,346,537 discloses wood tongs comprising two legs pivotally joined at their proximal ends. A first of the legs is configured with three longitudinally extending fingers at its proximal ends formed by cutting two longitudinal slits in the leg. The center or inner finger is pivotally joined to the proximal end of the second leg between two non-flexing fingers of the second leg. The pivot axis extends along the width dimensions of the legs at a location midway of the thickness of each joined leg. The ends of the two outer fingers resiliently abut the second leg proximate the pivot axis. The second leg has a complementary longitudinally extending slot defined therein and configured to receive portions of the central finger of the first leg as the distal ends of the legs are forced together during operation. Such forcing together causes the ends of the outer fingers to be resiliently flexed away from the second leg as increasing portions of the inner finger enter the slot in the second leg. Upon release of the force the spring-like resilient abutment of the ends of the outer fingers against the second leg causes the distal ends of the legs to spread apart to a quiescent or open position. Although this arrangement provides for a satisfactory gripping function, it suffers from the disadvantage of not lying optimally flat when the unit is stored. Specifically, the legs either remain in their open pivot position when stored, or are rotated in the opposite direction (i.e., opposite to the actuation direction) to a storage position in which the legs lie adjacent one another without any bias force acting between them. In this storage position the ends of the outer fingers project out of the plane of the first leg, thereby precluding flush surface to surface stacking of multiple tongs. In other words, the total thickness of the unit in the storage position is the width of the two legs plus the amount of out of plane projection of the fingers. This adds to the required storage space for one or more units and renders stacking awkward in view of the inability to stack flat planar surfaces flush against one another.

A second configuration of prior art tongs provides complementary fingers on both legs wherein the non-flexing center finger of the first leg is pivotally secured to the non-flexing outer fingers of the second leg. Specifically, the pivot point extends along the width dimension of the non-flexing legs at a location substantially midway of the thickness dimension of those legs. The resilient and foreshortened outer fingers of the first leg and center finger of the second leg are configured such that their ends biased out of plane relative to the adjacent fingers on the same leg. Specifically, the two resilient outer fingers of the first leg bend in a slight arc toward the second leg, and the single resilient fingers of the second leg bend in a slight arc toward the first leg. When the legs are forced together in use, the exposed ends of the resilient fingers of each leg abut the non-flexing fingers of the other leg to provide a resilient bias force against closure of the tongs. These tongs, like the tongs in the '537 patent, also function to grip in a satisfactory manner, but due to the normally out of plane projection of the ends of the resilient fingers, the tongs cannot be stacked flat when the legs are rotated to the storage position.

It is an object of the present invention to provide a tongs unit constructed in a manner that permits it to lay flat and use a minimum amount of space when stored and transported.

The objects of the invention are achieved individually and in combination, and it is not intended that the present invention be construed as requiring two or more of objects to be combined unless expressly required by the claims attached hereto.

SUMMARY OF THE INVENTION

In accordance with the present invention, tongs of the second type described above are modified, without sacrificing gripping function, to provide a storage position in which the legs lie in flush abutting relation so that the total thickness of the stored tongs unit is the thickness of the two legs. To accomplish this, all three of the fingers on each leg, when unstressed, reside in the same plane. In addition, the thickness of each of the joined non-flexing fingers is increased at the proximal end of the unit (i.e., at the hinge), permitting the pivot axis to be located substantially in the plane of abutment between the two legs in the storage position of the unit. In the actuation position, the ends of the foreshortened flexing fingers abut non-flexing fingers of the opposite leg to provide the desired resilient gripping function.

More specifically, a tongs unit of the present invention includes first and second substantially planar legs pivotally joined about a pivot axis at a proximal end of the unit. A resilient member is defined in at least the first leg for engaging the second leg and applying a bias force between the legs to urge them toward an open pivot position from which the legs can be pivotally forced together toward a closed gripping position by an external force applied in opposition to the bias force. The first and second legs have a storage pivot position in which the bias force is removed from between the legs and the legs abut one another along substantially their entire lengths in flush contact. The storage pivot position is pivotally displaced from the closed gripping position by approximately 360°. The outwardly facing surfaces of the legs in the storage pivot position are flat and smooth to permit stacking of plural tongs units in flush contact. The pivot axis resides substantially in a plane disposed between the legs in the storage pivot position. First, second and third longitudinally extending and transversely spaced fingers are disposed at the proximal end of the first leg and reside in a common plane corresponding to the plane of said first leg. Fourth, fifth and sixth longitudinally extending and transversely spaced fingers are disposed at the proximal end of the second leg and reside in a second common plane corresponding to the plane of said second leg. The first and third fingers are foreshortened relative to the second finger and are resiliently pivotable out of the plane of the first leg. The fifth finger is foreshortened relative to the fourth and sixth fingers and is resiliently pivotable out of the plane of the second leg. The pivot axis includes a pivot pin extending through said second, fourth and sixth fingers to pivotally join the legs. The first, second and third fingers are aligned with the fourth fifth and sixth fingers. An end of the first and third fingers abut the fourth and sixth fingers, respectively, in the open pivot position and are resiliently flexed out of the plane of the first leg in the closed position. An end of the fifth finger abuts the second finger in the open pivot position and is resiliently flexed out of the plane of the second leg in said closed position. The second, fourth and sixth fingers are larger at their proximal ends to receive the pivot pin.

The above and still further objects, features and advantages of the present invention will become apparent upon consideration of the following definitions, descriptions and descriptive figures of specific embodiments thereof wherein like reference numerals in the various figures are utilized to designate like components. While these descriptions go into specific details of the invention, it should be understood that variations may and do exist and would be apparent to those skilled in the art based on the descriptions herein.

DESCRIPTION OF THE PREFERED EMBODIMENTS

Figure 8:
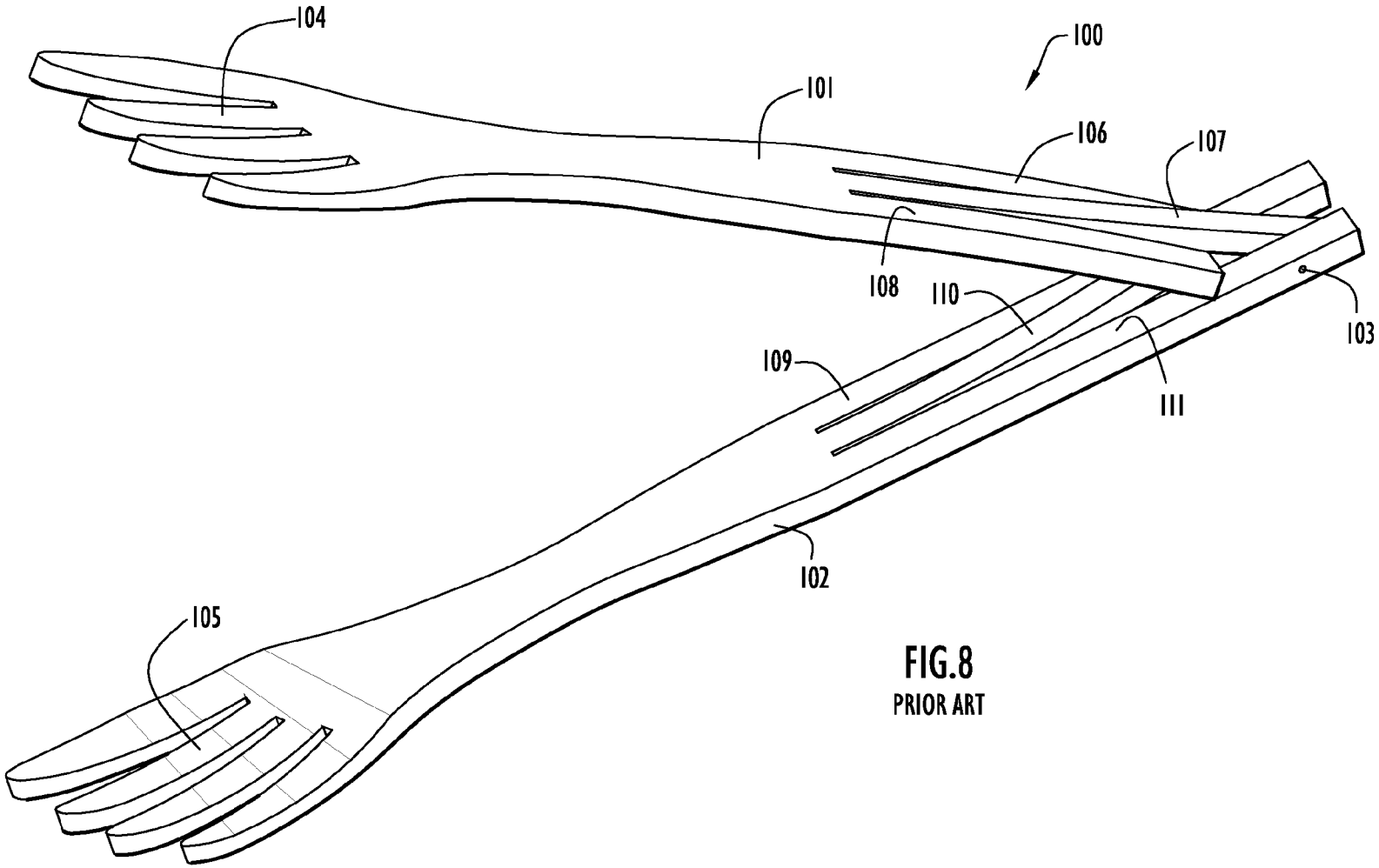
FIG.8 PRIOR ART
FIG. 8 is a view in perspective of prior art tongs in an open position.
Figure 9:
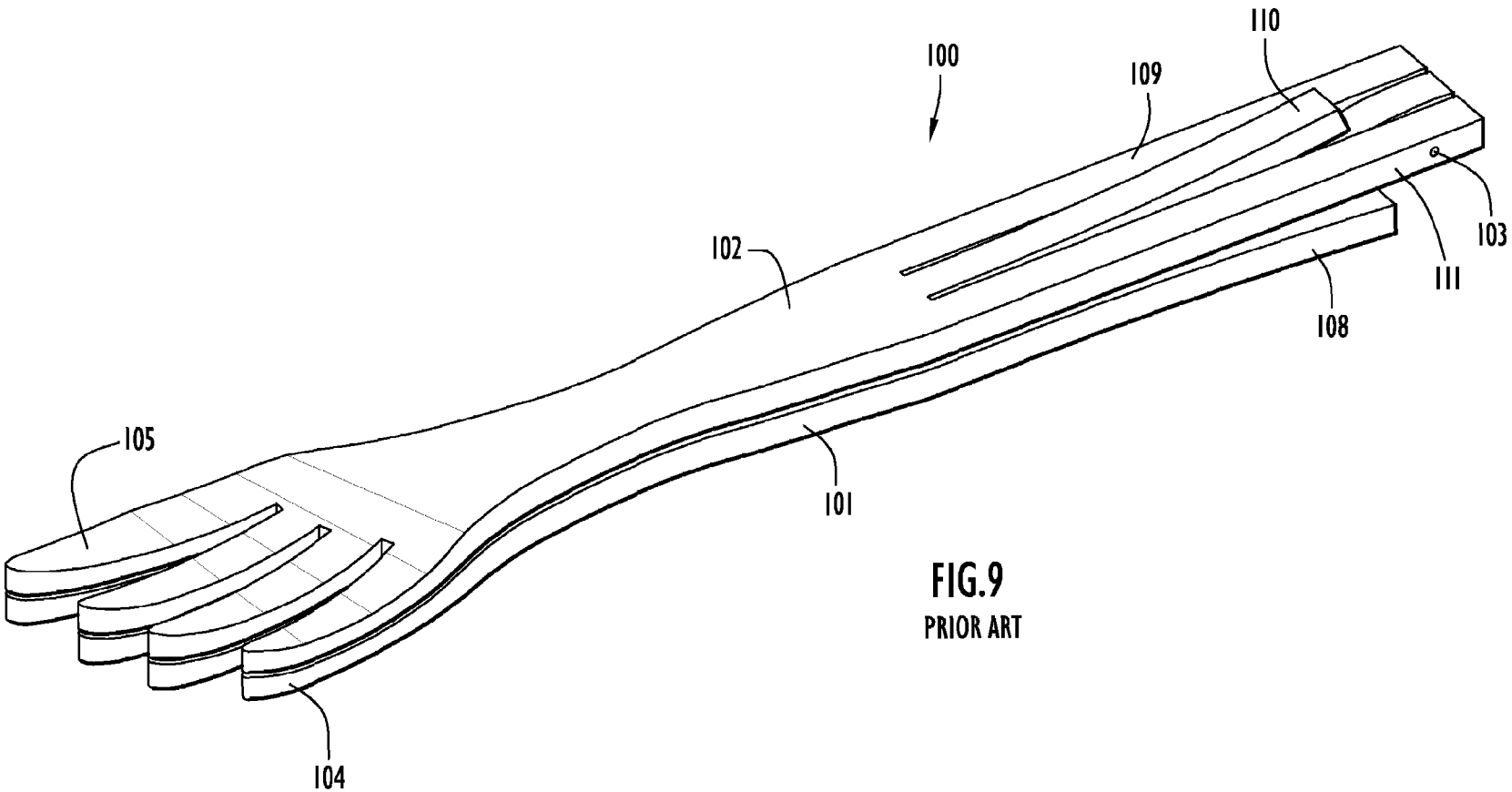
FIG.9 PRIOR ART
FIG. 9 is a view in perspective of the prior art tongs of FIG. 8 in the storage position.

Referring first to FIGS. 8 and 9, a prior art wood tongs unit 100 includes legs 101 and 102 joined at their proximal ends by a pivot pin 103. The legs have thickness dimensions shorter than their width dimensions. Pivot pin 103 extends along the width dimension at a location midway of the thickness dimensions of the legs. Legs 102, 103 terminate in respective fork-like members 104, 105 at their distal or gripping ends. It is to be understood that the gripping ends of this prior art unit and the units of the present invention may be spoons, scoops, spatulas, or any other type of members and, of themselves, form no part of the present invention.

The proximal end of leg 101 is subdivided into three longitudinally extending fingers 106, 107, 108 formed by lengthwise cuts extending from the leg proximal end part way (approximately 30% to 45%) along the length of the leg. The center finger 107 is longer than the outer two and extends to the proximal end of leg 101. Outer fingers 106, 108 are foreshortened relative to finger 107 which extends to define the proximal end of the leg. Fingers 106, 108 extend resiliently biased in a slight arc toward leg 102 when the unit is in its open position. Thus, the proximal ends of fingers 106 and 108 project slightly out of the common plane containing non-flexing finger 107 and the main body of leg 101.

The proximal end of leg 102 is subdivided into three longitudinally extending fingers 109, 110, 111 formed by lengthwise cuts extending from the proximal leg end part way (approximately 30% to 45%) along the length of the leg. Inner finger 110 is foreshortened relative to fingers 109, 111 which extend to define the proximal end of the leg. Finger 110 projects resiliently biased in a slight arc toward leg 101 when the unit in its open position. Thus, the proximal end of finger 110 projects slightly out of the common plane containing non-flexing fingers 109, 111 and the main body of leg 102. The out of plane projection of finger 110 is such that when the unit is in the storage position (FIG. 9), finger 110 projects in the opposite direction to the projection of finger 107, thereby increasing the thickness of the folded unit and making it difficult if not impossible to stack plural tongs.

The end of finger 107 extends into the gap between the ends of fingers 109 and 111 that is formed by the foreshortening of leg 110. Pivot pin 103 extends transversely through fingers 107, 109 and 110 to pivotally join legs 101 and 102 together. Pivot pin 103 is located midway through the depth or thickness dimension of these legs.

When tongs 100 are actuated by a force applied to bring legs 101, 102 toward a closed position from the open position (FIG. 8), the projecting ends of fingers 106, 108 of leg 101 are resiliently urged against non-flexing fingers 109, 111, respectively, of leg 102. Likewise, the projecting end of finger 110 of leg 102 is resiliently urged against non-flexing finger 107 of leg 101. These resilient engagements bias the legs apart against the actuating force and permit the unit to serve as tongs.

Figure 1:
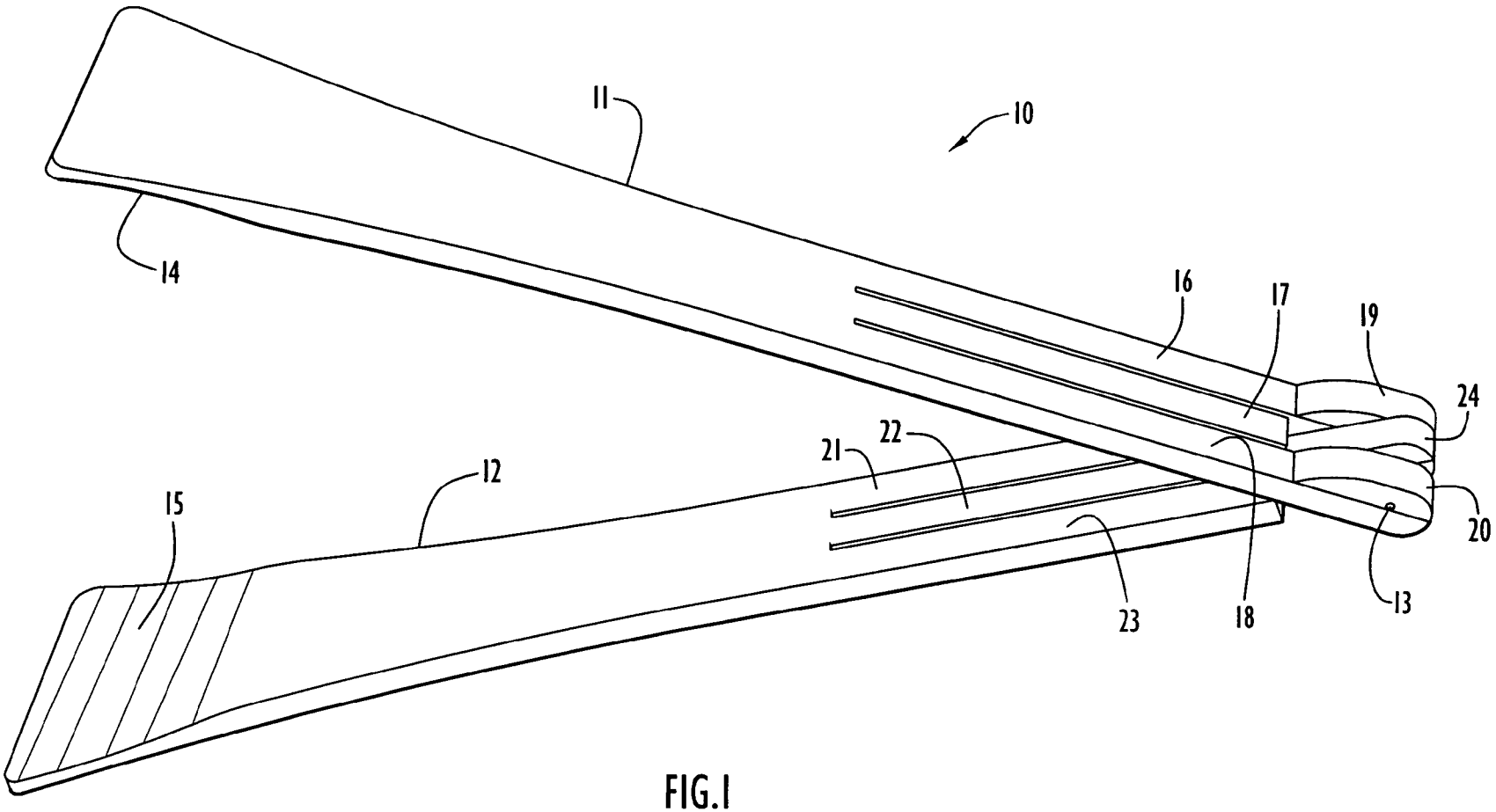
FIG. 1 is a view in perspective of tongs according to the present invention in an open position.
Figure 2:
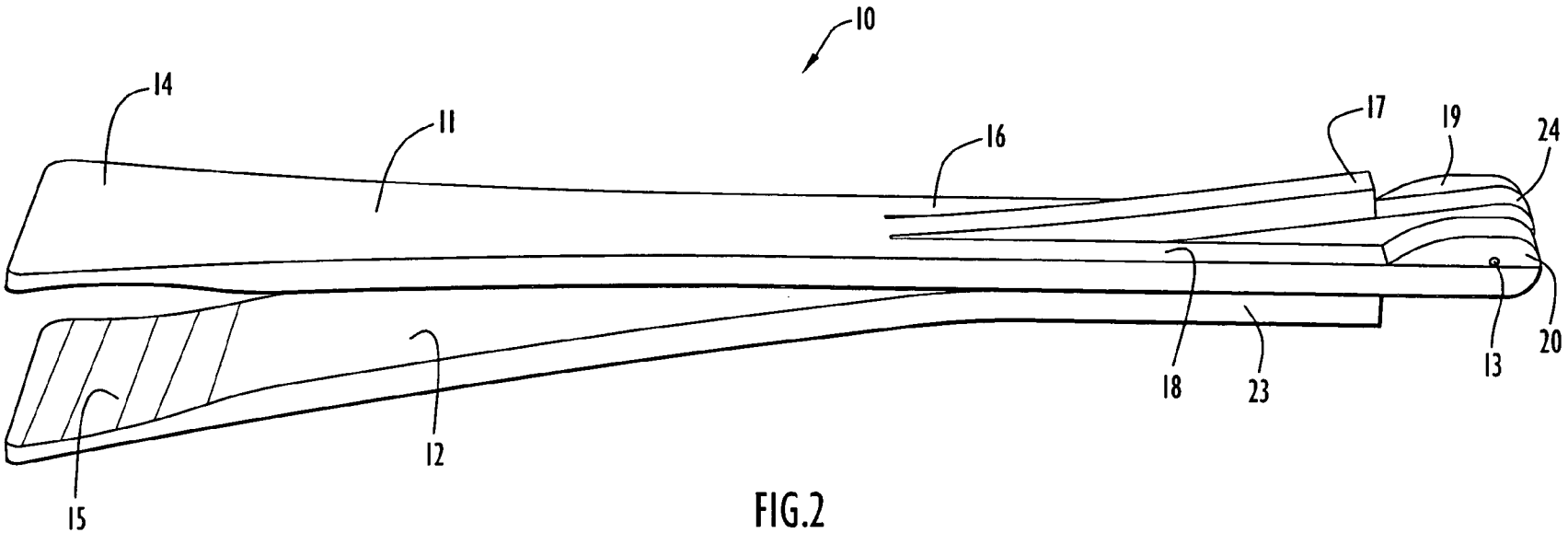
FIG. 2 is a view in perspective of the tongs of FIG. 1 in the actuated position.
Figure 3:
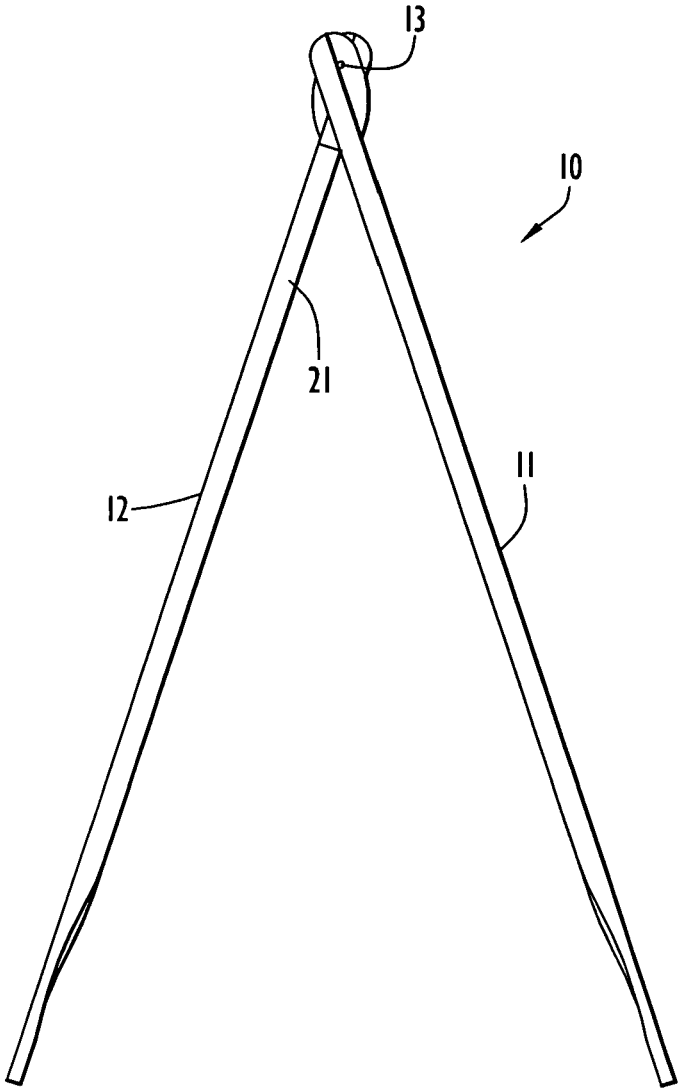
FIG. 3 is a side view in elevation of tongs of FIG. 1 in the open position.
Figure 4:
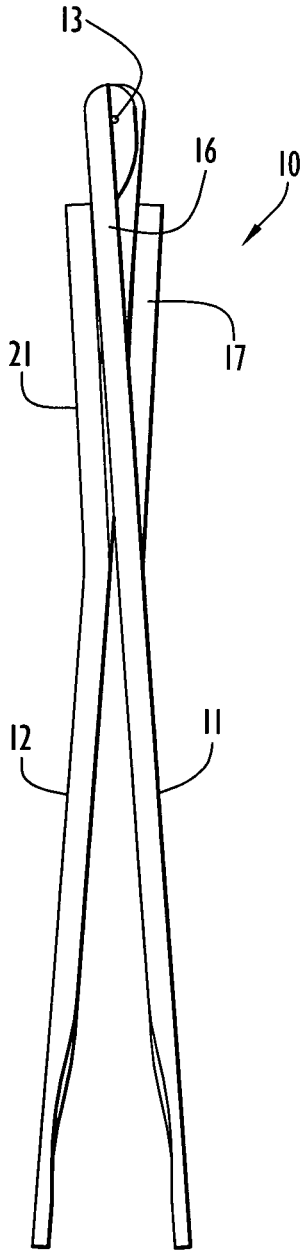
FIG. 4 is a side view in elevation of tongs of FIG. 1 in the actuated position.
Figure 5:
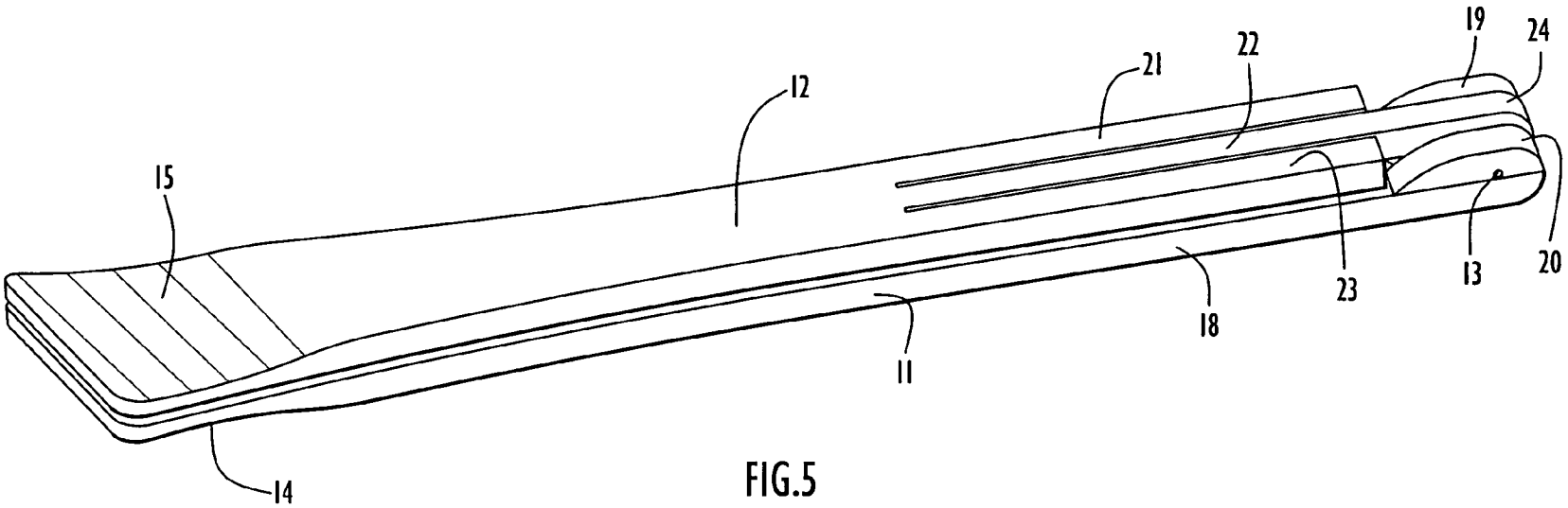
FIG. 5 is a view in perspective of the tongs of FIG. 1 in the storage position.

The disadvantage of not lying flat in the stored position is overcome by the present invention. Specifically, referring to FIGS. 1-6, tongs unit 10 includes legs 11, 12 joined at their proximal ends by a pivot pin 13. The legs have thickness dimensions shorter than their width dimensions. Pivot pin 13 extends along the width dimension at a location in the plane at which the flat facing surfaces of legs 11, 12 abut one another in the stored position (FIG. 5) of the unit. Since legs 11, 12 are movable relative to one another, it is necessary to increase the thickness of the proximal ends of legs 11, 12 (as in the manner described below) to provide a volume of material sufficient to receive and support pivot pin 13. Legs 11, 12 terminate in respective gripping members 14, 15 at their distal or gripping ends. It is to be understood that the gripping ends may be spoons, scoops, forks, spatulas, or any other type of member and, of themselves, form no part of the present invention.

The proximal end of leg 11 is subdivided into three longitudinally extending fingers 16, 17, 18 formed by lengthwise cuts extending from the proximal end part way (approximately 30% to 45%) along the length of the leg. The center finger 17 is shorter than fingers 16, 18 which are thicker at their proximal ends and extend to define the proximal end of leg 11. All three fingers 16, 17 18 reside in a common plane which is the nominal plane of leg 11. Because of the cuts, central finger 17 is pivotally resiliently flexible out of that common plane when subjected to an applied force in the thickness direction of the leg. Non-flexing fingers 16, 18 are provided with thickness-increasing blocks 19, 20, respectively, at their proximal ends to provide the additional volume of material described above as needed to receive and support pivot pin 13.

The proximal end of leg 12 is subdivided into three longitudinally extending fingers 21, 22, 23 formed by lengthwise cuts extending from the proximal end part way (approximately 30% to 45%) along the length of the leg. The center finger 22 is longer than fingers 21, 23 and is thicker at its proximal end which defines the proximal end of leg 12. All three fingers 21, 22, 23 reside in a common plane which is the nominal plane of leg 12. Because of the cuts, outer fingers 21. 23 are pivotally resiliently flexible out of that common plane when subjected to an applied force in the thickness direction of the leg. Non-flexing finger 22 is provided with thickness-increasing block 24 at its proximal ends to provide the additional volume of material described above as needed to receive and support pivot pin 13. The pivot pin thus extends through the juncture of blocks 19, 20, 24 with the extensions of their respective fingers. In this embodiment the proximal end thickness increase is provided by added blocks 19, 20, 24 which are glued, nailed or otherwise permanently secured to their respective fingers. It should be noted that the added thickness can alternatively be provided by forming the thicker ends as integral parts of the finger structures.

The tongs unit 10 has three nominal pivot positions, namely:

(a) A gripping position (FIGS. 2, 4) in which gripping members 14, 15 grip an object. In this position, a bias force is applied between the legs 11, 12 to urge them apart toward an open position. The gripping position encompasses a range of angles between zero and the open position.

(b) An open position (FIGS. 1, 3) at which the bias force no longer acts between legs 11, 12. The open position encompasses a range of angles between the legs that extends from the end of the closed position range to 360°. The nominal open position, (i.e., the smallest angel at which the bias force does not act to further separate the legs) is preferably between 25° and 35° but can be outside that range without departing from the principles of the invention.

(c) A storage position (FIG. 5) in which the legs 11, 12 are rotated to a position 360° from the fully closed gripping position.

Legs 11, 12 have substantially flat, planar interiorly-facing surfaces which face one another in the open and gripping positions. The legs also have substantially flat, planar exteriorly-facing surfaces which face one another and abut in flush contact in the storage position. All of the fingers, when not subject to an externally applied closing force in the range of gripping position angles, reside entirely within the planes of the exteriorly and interiorly facing surfaces. That is, the fingers do not project beyond the normal thickness dimension of their legs unless a closing or gripping force is applied to the legs.

When the unit is actuated from the biased open position (FIGS. 1, 3) to the unstable closed position (FIGS. 2, 4) by a force applied to bring legs 11, 12 toward one another, the ends of flexible fingers 21, 23 of leg 12 are resiliently urged against non-flexing fingers 16, 18 respectively, of leg 11. Likewise, the projecting end of flexible finger 17 of leg 102 is resiliently urged against non-flexing finger 22 of leg 12. These resilient engagements are directed to bias the legs apart in opposition to the actuating force applied in a conventional manner by the user's hand, thereby permitting the unit to serve as gripping tongs.

Figure 6:
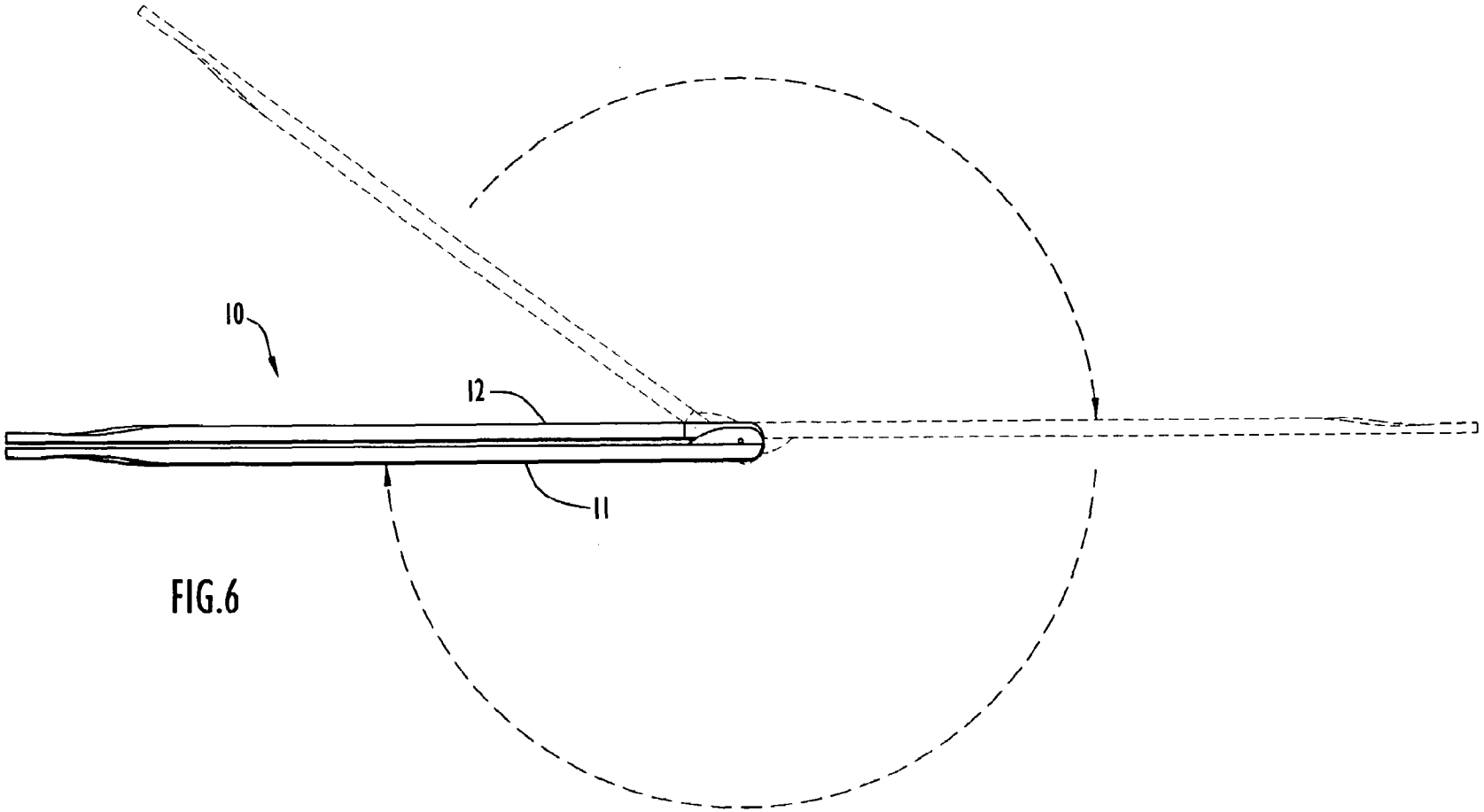
FIG. 6 is a partially diagrammatic side view of the tongs of FIG. 1 demonstrating movement between the actuated position and storage position.

Rotation of the legs 11, 12 about pin 13 to the storage position (FIG. 5) in the manner illustrated in FIG. 6 causes the exteriorly-facing surfaces of the legs to make flush contact with one another. This flush contact is enabled by the location of pivot pin 13 in the plane disposed between the abutting exteriorly-facing leg surfaces. In addition, since all of the fingers reside with the planes of their respective legs, no part of the unit projects outside the planes of the legs and the unit can be efficiently stored and stacked with other units.

The dimensions of the blocks 19, 20, 24 are chosen to permit unimpeded rotation of the legs 11, 12 between the open and storage positions and to not increase the thickness of the unit when in the storage position. Specifically, the lengths of the blocks along the legs correspond to slightly less than the foreshortening of fingers 17, 21, 23 relative to fingers 16, 18, 22. This prevents the resilient foreshortened fingers 17, 21, 23 from partially overlying respective blocks 24, 19, 20 in the storage position which would force those fingers out of the planes of their respective legs. The thicknesses of the blocks are equal to or less than the thicknesses of the resilient foreshortened fingers so that the thickness dimensions of blocks 24, 19, 20 do not extend beyond the thickness of respective fingers 17, 21, 23 in the storage position of the unit.

Figure 7:
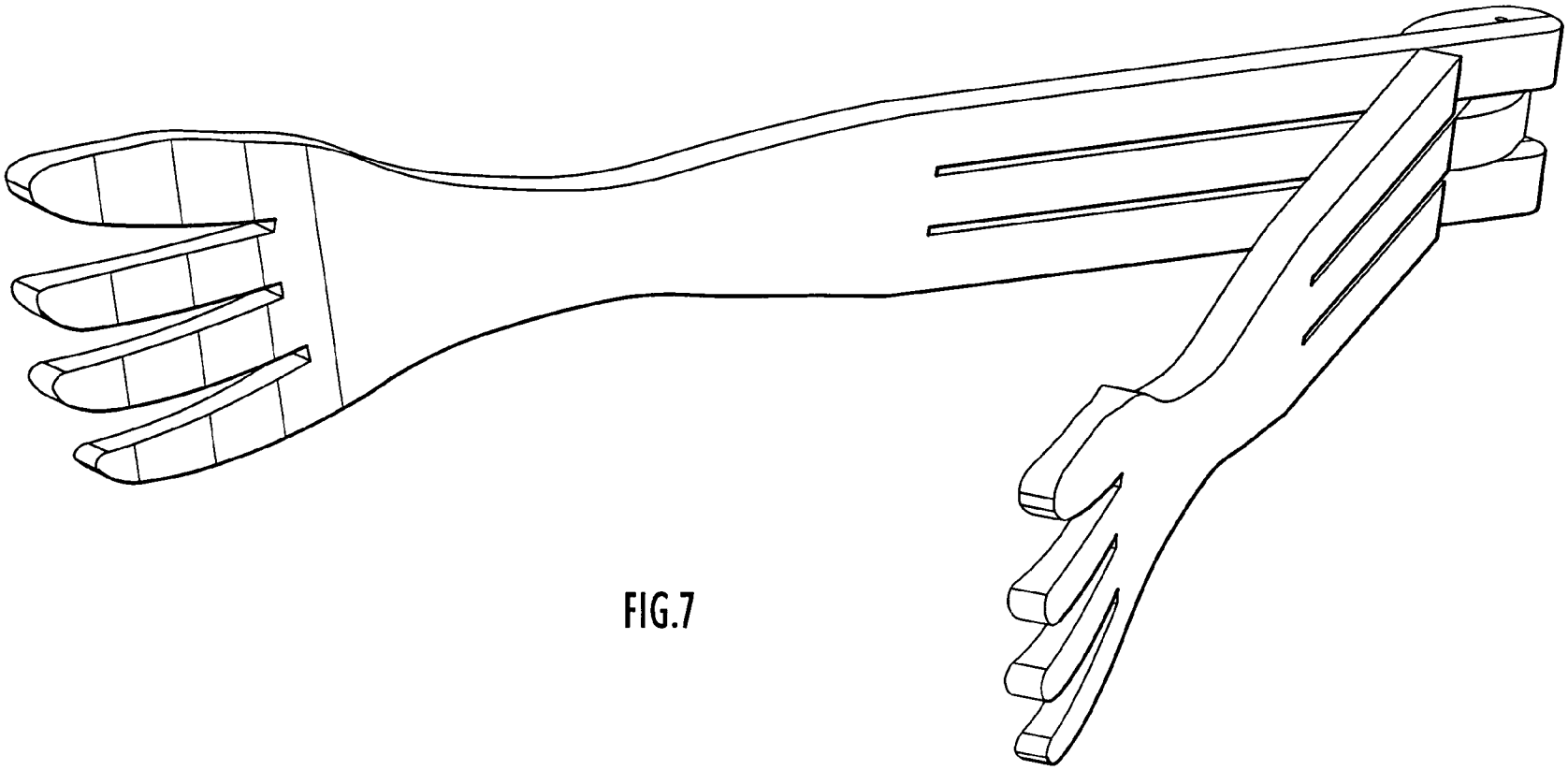
FIG. 7 is a view in perspective of another tongs embodiment according to the present invention in an open position.

The embodiment illustrated in FIG. 7 is an example of the principles of the present invention with forks used as gripping members. The same leg, finger and pivot structures are present in this embodiment.

Although the tongs of the invention are preferably embodied in wood, it is to be understood that other materials capable of the resilient properties described herein may be used without departing from the principles of the invention. Examples of notable alternative materials would be polymers having the stated properties. Certain metals (e.g., aluminum, spring steel, etc.) having the resilient characteristics required to perform the functions described herein may also be used.

The size of the tongs is also not a limiting aspect of the invention, since any size appropriate to the function of the tongs may be employed. Thus, for example, salad tongs may have legs on the order of fifteen to twenty-four inches long. Other applications may require tong leg lengths as small as four to six inches.

Having described preferred embodiments of a new and improved foldable tongs unit, it is believed that other modifications, variations and changes will be suggested to those skilled in the art in view of the teachings set forth herein. It is therefore to be understood that all such variations, modifications and changes are believed to fall within the scope of the present invention as defined by the appended claims. Although specific terms are employed herein, they are used in a generic and descriptive sense only and not for purposes of limitation.

What is claimed is:

1. A tongs unit comprising:

first and second legs pivotally joined about a pivot axis at a proximal end of the unit, each leg having a respective thickness dimension defined between substantially flat planar inwardly facing and outwardly facing surfaces; and at least one resilient member defined in at least said first leg for engaging said second leg and applying a bias force between said legs to urge the legs toward an open pivot position from which said legs can be pivotally forced together toward a closed gripping position by an external force applied in opposition to the bias force; said resilient member residing entirely within the thickness dimension of said first leg in the absence do said external force;

said first and second legs having a storage pivot position in which said bias force is removed from between said legs and said outwardly facing surfaces of said legs abut one another along substantially their entire lengths in flush substantially planar contact, said storage pivot position being pivotally displaced from said closed gripping position by approximately 360°;

wherein the outwardly facing surfaces of said legs in said storage pivot position are flat and substantially planar to permit stacking of plural tongs units in flush contact.

2. The tongs unit of claim 1 wherein said pivot axis resides substantially in a plane disposed between said legs in said storage pivot position.

3. The tongs unit of claim 2 further comprising gripping members disposed at distal ends of said legs.

4. The tongs unit of claim 2 further comprising:

at least an other resilient member defined in said second leg for engaging said first leg and enhancing the bias force between said legs to further urge the legs toward an open pivot position from which said legs can be pivotally forced together toward a closed gripping position by said external force applied in opposition to the bias force, said other resilient member residing entirely within the thickness dimension of said first leg in the absence of said external force;

first, second and third longitudinally extending and transversely spaced fingers disposed at the proximal end of said first leg, said first, second and third fingers residing in a first common plane corresponding to the plane of said first leg;

fourth, fifth and sixth longitudinally extending and transversely spaced fingers disposed at the proximal end of said second leg, said fourth, fifth and sixth fingers residing in a second common plane corresponding to the plane of said second leg;

wherein said first and third fingers comprise said at least one resilient member, are foreshortened relative to said second finger and are resiliently pivotable out of the plane of said first leg, wherein said fifth finger comprises said other resilient member, is foreshortened relative to said fourth and sixth fingers and is resiliently pivotable out of the plane of said second leg, and wherein said pivot axis includes a pivot pin extending through said second, fourth and sixth fingers to pivotally join said legs.

5. The tongs unit according to claim 4 wherein said first, second and third fingers are aligned with said fourth fifth and sixth fingers;

wherein ends of said first and third fingers abut said fourth and sixth fingers, respectively, in said open pivot position and are resiliently flexed out of the plane of said first leg in said closed position; and wherein an end of said fifth finger abuts said second finger in said open pivot position and is resiliently flexed out of the plane of said second leg in said closed position.

6. The tongs unit of claim 5 wherein said second, fourth and sixth fingers are larger at their proximal ends to receive said pivot pin.

7. The tongs unit of claim 4 wherein said pivot axis includes a pivot pin extending through said second, fourth and six fingers to pivotally join said legs.

8. The tongs unit of claim 7 wherein said second, fourth and sixth fingers are thicker at their proximal ends to receive said pivot pin.

9. A tongs unit comprising:

first and second legs pivotally joined about a pivot axis at a proximal end of the unit, said legs having at least three pivot positions, namely a gripping position, an open position and a storage position; and means for applying a resilient bias force between said legs;

wherein said gripping position encompasses a range of angles extending from a fully closed position to said open position and in which said bias force is applied between said legs to urge them apart toward said open position;

wherein said open position encompasses a range of angles extending from said gripping position to said storage position and in which said bias force is not applied between said legs;

wherein in said storage position the angle between said legs is 360° relative to the angle between said legs in the fully closed gripping position; and wherein said pivot axis resides substantially entirely in a plane parallel to and disposed between said legs in said storage position.

10. The tongs of claim 9 wherein, in said storage position, said means resides entirely between said respective uninterruptedly substantially parallel planes.

11. A tongs unit comprising:

first and second substantially planar legs pivotally joined about a pivot axis at a proximal end of the unit;

a first resilient member defined in said first leg for engaging said second leg and applying a bias force between said legs to urge the legs toward an open pivot position from which said legs can be pivotally forced together toward a closed gripping position by an external force applied in opposition to the bias force;

a second resilient member defined in said second leg for engaging said first leg and enhancing said bias force between said legs to further urge the legs toward the open pivot position from which said legs can be pivotally forced together toward a closed gripping position by the external force applied in opposition to the bias force; and said first and second legs having a storage pivot position in which said bias force is removed from between said legs and said legs abut one another along substantially their entire lengths in flush contact, said storage pivot position being pivotally displaced from said closed gripping position by approximately 360° ;

wherein the outwardly facing surfaces of said legs in said storage pivot position are flat and smooth to permit stacking of plural tongs units in flush contact.

wherein said pivot axis resides substantially in a plane disposed between said legs in said storage pivot position;

and further comprising:

first, second and third longitudinally extending and transversely spaced fingers disposed at the proximal end of said first leg, said first, second and third fingers residing in a first common plane corresponding to the plane of said first leg in the absence of application of said external force;

fourth, fifth and sixth longitudinally extending and transversely spaced fingers disposed at the proximal end of said second leg, said fourth, fifth and sixth fingers residing in a second common plane corresponding to the plane of said second leg in the absence of application of said external force;

wherein said first and third fingers comprise said first resilient member, are foreshortened relative to said second finger and are resiliently pivotable out of the plane of said first leg in response to application of said resilient force, wherein said fifth finger comprises said second resilient member, is foreshortened relative to said fourth and sixth fingers and is resiliently pivotable out of the plane of said second leg in response to application of said external force, and wherein said pivot axis includes a pivot pin extending through said second, fourth and sixth fingers to pivotally join said legs.

12. The tongs of claim 11 further comprising gripping members disposed at distal ends of said legs.

13. The tongs unit of claim 12 wherein said pivot axis includes a pivot pin extending through said second, fourth and sixth fingers to pivotally join said legs.

14. The tongs unit of claim 11 wherein said second, fourth and sixth fingers are thicker at their proximal ends to receive said pivot pin.

* * * * *

UNITED STATES PATENT AND TRADEMARK OFFICE

CERTIFICATE OF CORRECTION

PATENT NO. : 7,665,786 B2
APPLICATION NO. : 11/448987
DATED : February 23, 2010
INVENTOR(S) : Simons It is certified that error appears in the above-identified patent and that said Letters Patent is hereby corrected as shown below:

Column 6, line 45, replace "absence do said" with -- absence of said --.

Signed and Sealed this

Sixth Day of April, 2010

David J. Kappos

David J. Kappos
*Director of the United States Patent and Trademark Office*